United States Patent [19]

Nachtrieb

[11] 4,057,375

[45] Nov. 8, 1977

[54] PUMP STRUCTURE

[76] Inventor: Paul W. Nachtrieb, 6392 Park Ave., Garden Grove, Calif. 92645

[21] Appl. No.: 735,026

[22] Filed: Oct. 22, 1976

[51] Int. Cl.[2] ..... F01C 1/18; F01C 21/12; F04C 1/08; F04C 15/02

[52] U.S. Cl. ..... 418/189; 418/206

[58] Field of Search ..... 418/189, 205, 206

[56] References Cited

U.S. PATENT DOCUMENTS

| | | | |
|---|---|---|---|
| 902,702 | 11/1908 | Wainwright | 418/206 |
| 1,035,468 | 8/1912 | Reagan | 418/206 |
| 1,129,091 | 2/1915 | Hawley | 418/206 |
| 1,362,621 | 12/1920 | Hawley | 418/206 |
| 1,666,321 | 4/1928 | Weeden | 418/205 |
| 2,446,194 | 8/1948 | Samiran | 418/206 |
| 2,934,260 | 4/1960 | Rosentrater | 418/206 |

FOREIGN PATENT DOCUMENTS

| | | | |
|---|---|---|---|
| 9,656 of | 1895 | United Kingdom | 418/206 |
| 287,426 | 3/1928 | United Kingdom | 418/206 |

*Primary Examiner*—John J. Vrablik
*Attorney, Agent, or Firm*—William C. Babcock

[57] ABSTRACT

A semi-positive displacement pump of modular structure that includes a center plate, a pump defining housing removably secured to a first side thereof, a gear containing housing removably affixed to a second side, first and second impellers disposed in spaced relationship in the pump cavity between a fluid inlet and fluid outlet defined therein. The pump may be selectively driven either manually or by power means. The bottom of the pump chamber and the surface of the center plate most adjacent the pump chamber have first and second sets of aligned pressure relief cavities formed therein. The first and second impellers include first and second cylindrical hubs of substantial diameter that have their ends closely disposed to transverse center portions of the bottom of the pump chamber and center plate defined between the first and second pressure relief cavities formed therein. The first and second impellers have first and second circumferentially spaced vanes extending radially therefrom which cooperate with the interior surface of the pump chamber to define first and second laterally spaced confined spaces that force fluid from the inlet to the outlet side of the pump chamber as the first and second impellers are counter-rotated.

9 Claims, 6 Drawing Figures

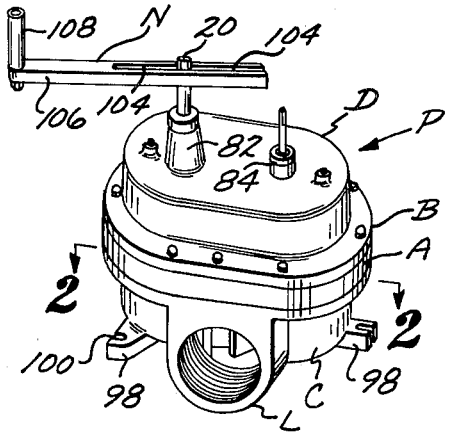
FIG. 1
FIG. 2
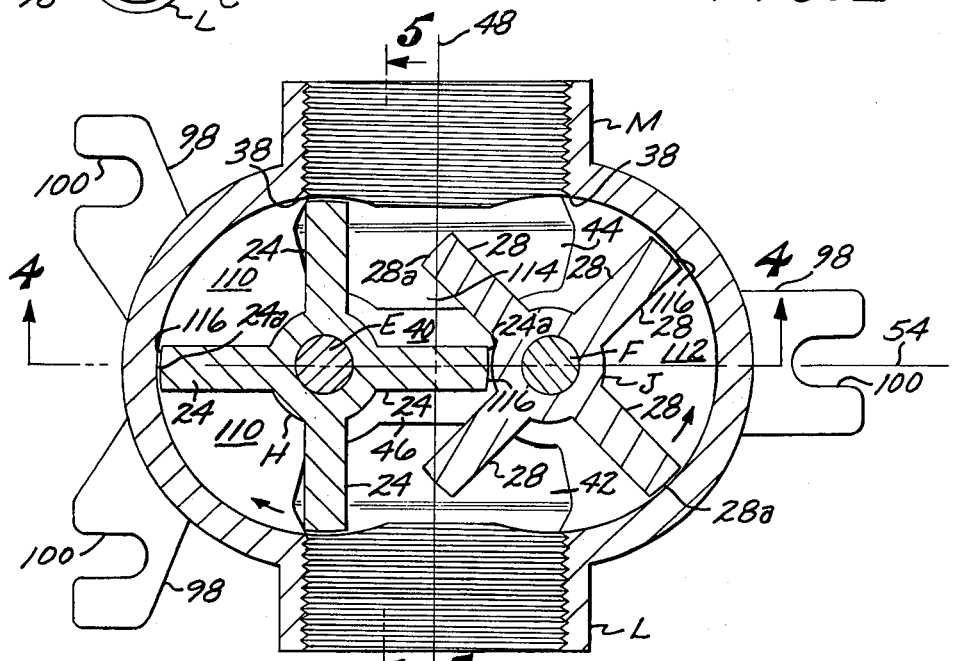
FIG. 3
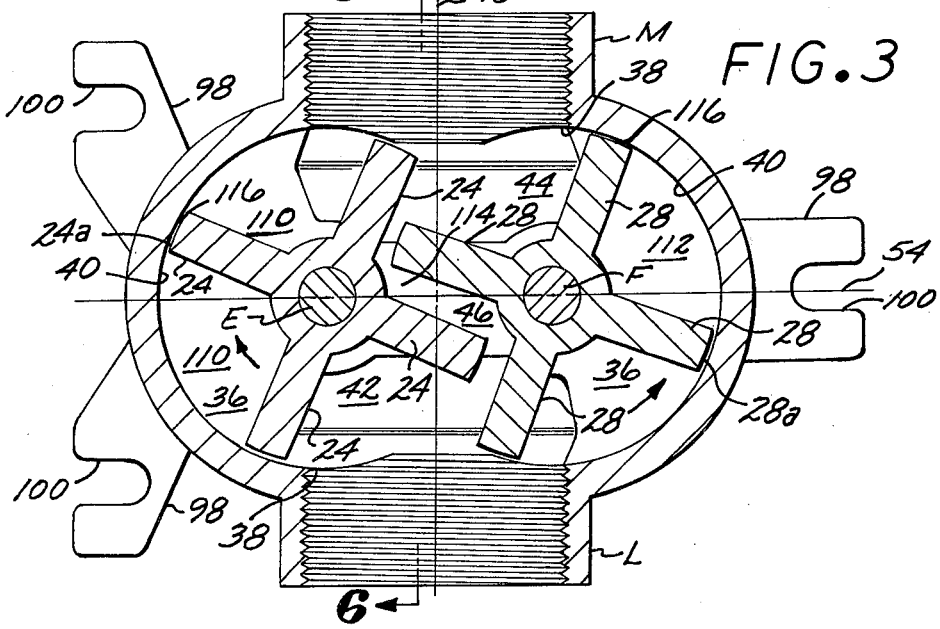

PUMP STRUCTURE

BACKGROUND OF THE INVENTION

1. Field of the Invention

Pump Structure.

2. Description of the Prior Art

Centrifugal pumps and positive displacement pumps have, in the past, been commonly used in moving fluids and liquids to a desired location. The centrifugal pump, as is well known, obtains its pumping action by whirling the liquid to be pumped at high speeds and allowing the liquid to escape through a suitable chamber and port. Although centrifugal pumps are simple and durable, they usually are inefficient, have little lift capacity, and develop only moderate head pressure. Multi-stage versions of centrifugal pumps are generally used where high head pressures are required, but such pumps ae complicated in design, are expensive, and usually less efficient than a single stage centrifugal pump of equivalent capacity.

In the past, where low capacity and high head pressure is required, positive displacement pumps have frequently been used for this purpose, with the pumps being generally classified as gear, vane, screw, lobe, or of the piston type. Positive displacement pumps are capable of developing high head pressure, but are rarely built in large capacity size, to compete with centrifugal pumps on a volume basis. The commercial reason for limiting positive displacement pumps to those of relative low capacity, is that the cost of building positive displacement pumps of high capacity is prohibitively expensive, with the pumps being excessively bulky compared to a centrifugal pump of equivalent capacity.

The primary purpose in developing the present invention is to provide a pump having a performance not common to the prior art pumps of the centrifugal and positive displacement types. The present pump, for example, in the larger sizes has external dimensions that will be less than centrifugal pumps of like capacity, and with the pressure not possible with single stage centrifugal pumps. The present invention has no physical contact between moving parts within the pump chamber, and as a result has a projected long useful operating life compared to centrifugal pumps. Due to the present invention's low cost, durability, compactness, and efficiency in operation, it is anticipated that the present invention will not only eventually replace many high capacity centrifugal pumps, but will also open a pump market not currently regarded as practical with present-day pumping equipment.

A primary object of the present invention is to supply a semi-positive displacement pump that has operational advantages not common to prior art centrifugal and positive displacement pumps and more specifically a pump of modular structure that may be modified as to the transmission ratio at which the pump operates as well as the rate of discharge, has a high discharge capacity relative to its size, can develop a high head pressure, is reversible as to flow, is self-lubricating, and requires a minimum of maintenance attention due to having no movable components in rubbing contact with the pump chamber.

Another object of the invention is to provide a pump which in the low capacity sizes may be selectively operated by manual means, or by power means, and with the pump capable of being built from standard commercially available materials at a low cost, and this low cost coupled with the efficiency of operation of the pump encouraging the widespread use thereof both for low and high capacity needs.

SUMMARY OF THE INVENTION

The semi-positive displacement pump, the subject of the present invention, is of the type that includes first and second counter-rotating impellers situated on spaced parallel axes, with each of the impellers including a cylindrical hub from which a number of circumferentially spaced vanes extend radially. The first and second impellers when synchronously rotated sequentially define first and second laterally spaced confined spaces by which fluid is forced from the inlet side of the pump chamber to the outlet side thereof. The vanes of the first and second impellers after passing the fluid outlet intermesh and sequentially define third confined spaces of variable volume that move a portion of pressurized fluid from the outlet side of the pump chamber to the inlet side thereof.

The pump includes first, second and third shafts each of which has first and second end portions, with the first and second hubs engaging the first and second shafts adjacent the first end portions thereof, and the hubs being removably secured to the shaft. A first gear is removably secured to the second end portion of the first shaft. A second gear is removably secured to the second shaft intermediate the first and second end portions thereof and is in engagement with the first gear. A third gear is removably secured to the second end portion of the third shaft. A fourth gear is defined on the exterior surface of the second shaft, and the fourth gear being engaged by the third gear.

A center plate is provided that has first and second spaced openings therein that rotatably engage intermediate portions of the first and second shaft, and the center plate having a number of spaced transverse first bolt holes adjacent the periphery thereof. A first housing is provided that includes a flat bottom and a first continuous side wall that extends upwardly from the latter, with the side wall having an oppositely disposed fluid inlet and fluid outlet therein. First and second elongate transverse fluid pressure release cavities are formed in the bottom of the housing adjacent the fluid inlet and fluid outlet. The first and second cavities are separated by a first portion of the bottom in which first and second recesses are formed that rotatably engage the first end portions of the first and second shaft. The first side wall on the upper extremity thereof develops into first outwardly extending flange that has a number of spaced second bolt holes therein that are alignable with the first bolt holes. The surface of the center plate most adjacent the first housing has third and fourth pressure relief cavities therein that are aligned with the first and second cavities previously mentioned. The first housing, when the first flange is in abutting contact with the center plate, cooperates with the latter to define a chamber in which the first and second impellers are rotatably disposed.

A second housing is provided that includes a top from which a continuous side wall depends, which side wall develops into an outwardly extending second flange in which a number of spaced bolt holes are defined that are alignable with the first bolt holes when the second flange is in abutting contact with the center plate. The second housing has first and second openings therein that rotatably engage the second and third shaft, with the second housing cooperating with the center plate to define a confined space in which the first, second, third and fourth gears are disposed.

A number of bolts are provided that engage the first, second and third bolt holes to removably hold the first and second housings in abutting contact with the pressure plate. A crank is provided that is of such structure that it may removably engage the second end portion of the third shaft to manually rotate the latter, and as the shaft rotates it drives the first, second, third and fourth gears to impart constant synchronized rotation to the first and second impellers for fluid to be pumped in the first and second confined spaces as the latter move from the inlet to the outlet in the pump chamber. When the fluid in the third confined spaces is incompressible, it does not impart shock to the vanes as the third confined spaces decrease in volume, for as the pressure on fluid in the third confined spaces increases the pressurized fluid may flow to either the first or second pressure relief cavities.

The second end portion of the second shaft is removably engageable with the drive of a prime mover such as an electric drill or the like, to permit the prime mover to drive the first and second shafts and the first and second impellers to pump fluid in the same manner as though the first and second shaft were driven by the manual rotation of the third shaft. It will be particularly noted that the center plate cooperates with the first and second housing to define the pump chamber and the confined space in which the first, second, third and fourth gears are disposed, and the center plate also serving to define third and fourth fluid pressure relief cavities therein that are aligned with the first and second cavities, and the center plate further in cooperation with the first and second flanges and bolts serving to removably hold the first and second housings in fixed space relationship relative to one another.

The pump above-described, due to its modular structure, is versatile in operation. If a pump of greater capacity is desired, the first housing and first and second impellers are replaced by a different first housing and different first and second impellers that are of greater or lesser depth and accordingly discharge fluid at a greater or lesser rate than the first and second impellers and housing that they replace.

BRIEF DESCRIPTION OF THE DRAWINGS

FIG. 1 is a perspective view of the semi-positive displacement pump with a crank removably mounted thereon for manually driving the pump;

FIG. 2 is a transverse cross-sectional view of the pump shown in FIG. 1 taken on the line 2—2 thereof;

FIG. 3 is the same transverse cross-sectional view as shown in FIG. 2, but with the first and second impellers having been moved to a different position than FIG. 2;

DESCRIPTION OF THE PREFERRED EMBODIMENT

Figure 4:
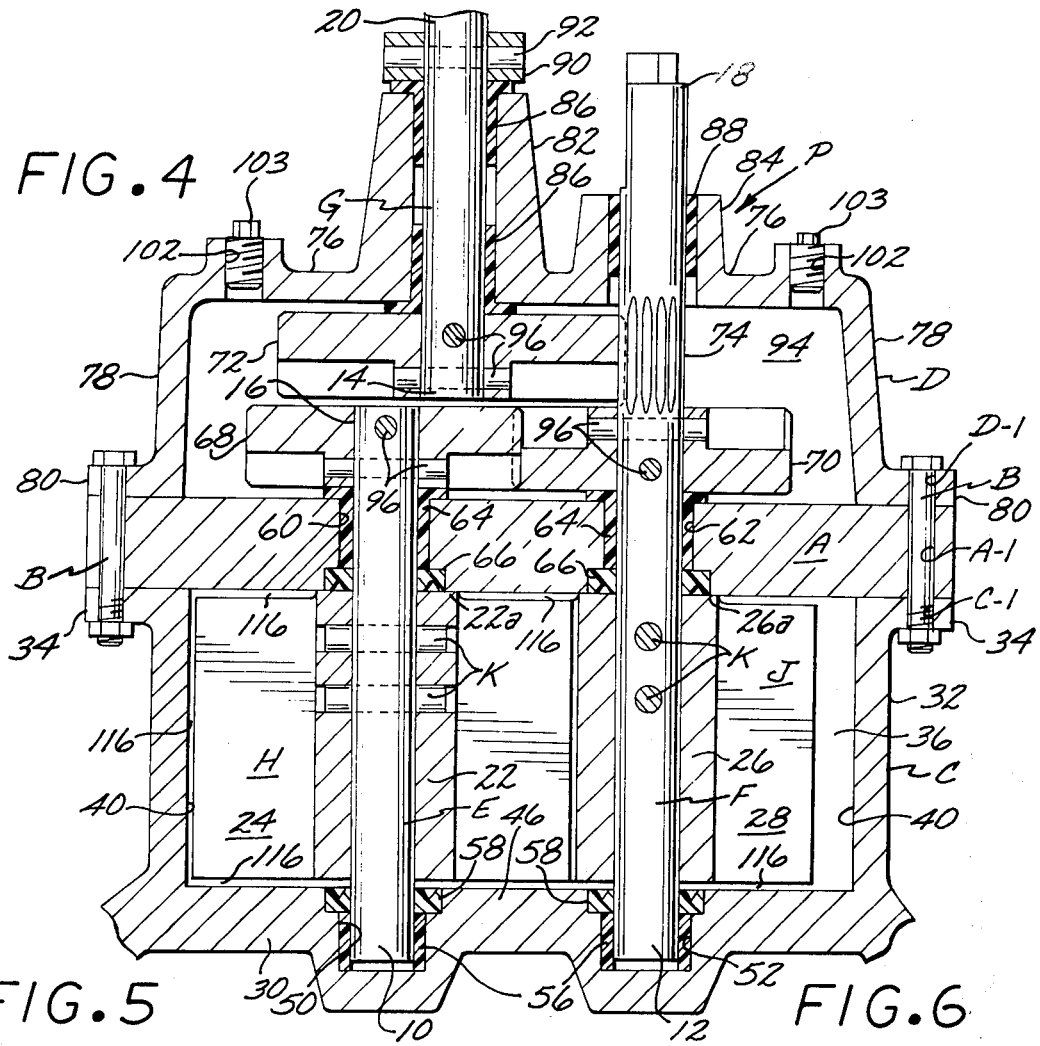
FIG. 4 is a vertical cross-sectional view of the pump taken on the line 4—4 of FIG. 2.

The semi-positive fluid displacement pump P as may best be seen in FIGS. 1 and 4, includes a center plate A which, in cooperation with bolts B, serves to hold a first housing C and second housing D in a fixed spacing relative to one another. First, second and third aligned bolt holes A-1, C-1, and D-1, are defined in the center plate A, first housing C, and second housing D, and are removably engaged by the bolts B.

First, second and third shafts E, F and G are provided, which shafts have first end portions 10, 12, and 14, and second end portions 16, 18, and 20. The pump P includes a first impeller H that has a generally cylindrical hub 22 from which a number of circumferentially spaced vanes 24 extend radially. The pump P also includes a second impeller J that has a generally cylindrical hub 26 from which circumferentially spaced vanes 28 extend radially.

The first housing C includes a generally flat bottom 30 from which a continuous side wall 32 extends upwardly to terminate in an outwardly disposed flange 34 in which the second bolt holes C-1 are defined. The first housing C, in cooperation with a lower side surface of the center plate A, serves to define a pump chamber 36 as shown in FIG. 4, which pump chamber has two laterally spaced generally straight side wall surfaces 38 and two semi-cylindrical interior end surfaces 40. A tubular fluid inlet L and a tubular fluid outlet M are defined on the first housing C and are centered on a center line 48. First and second fluid pressure release cavities 42 and 44 extend downwardly into the bottom 30 and are situated on opposite sides of a center portion 46 of bottom 30, which center portion is normally disposed to the center line 48. The bottom 30 in the center portion 46 thereof, has first and second cavities 50 and 52 defined therein, which cavities are centered on a center line 54 that is normal to the center line 48. The first and second cavities 50 and 52 have sleeve bearings 56 disposed therein as well as sealing rings 58.

The center plate A has first and second transverse bores 60 and 62 formed therein that are in alignment with the first and second cavities 50 and 52. Bores 60 and 62, as best seen in FIG. 4 support sleeve bearings 64 and sealing rings 66.

First, second, third, and fourth gears 68, 70, 72 and 74 are provided, with the fourth gear being defined on the second shaft F in a position adjacent the top 76 as shown in FIG. 4. The second housing D includes the top 76 and a continuous side wall 78 that extends downwardly from the periphery thereof, with the side wall 78 terminating in an outwardly extending flange 80 in which the third bolt holes D-1 are defined. The top 76 has first and second tubular bosses 82 and 84 extending upwardly therefrom. The first boss 82 has a pair of sleeve bearings 86 disposed therein. Sleeve bearing 88 is mounted in the second tubular boss 84. The third shaft G has a thrust bearing 90 mounted thereon and secured thereto by a pin 92 that extends through a line opening in the thrust bearing and third shaft as illustrated in FIG. 4.

The second housing D in cooperation with the center plate A serves to define a confined space 94 as shown in FIG. 4 in which the first, second, third and fourth gears 68, 70, 72 and 74 are disposed. The first gear 68 is removably secured to the second end portion 16 of first shaft E by pins 96 that extend diametrically through the first gear and the first shaft. The first gear 68 is in meshed engagement at all times with a second gear 70 that is secured to the second shaft F by diametrically extending pins 96 that extend through openings in the gear and in the shaft. The first and second gears 68 and 70 as best seen in FIG. 4 are adjacently disposed to the upper surface of the center plate A. The third gear 72 is removably secured to the first end portion of the third shaft G by pins 96 that extend diametrically through the gear and aligned openings formed in the shaft. The third gear 72 is at all times in engagement with the fourth gear 74 illustrated in FIG. 4. The first housing C has a number of legs 98 secured thereto, which legs have transverse openings 100 therein through which bolts or other fastening means may be extended to secure the first housing C to a desired support (not shown). The top 76 has one or more internally threaded openings 102 extending transversely therethrough, and through which openings lubricant may be introduced into the confined space 94. The internally threaded openings 102 are normally closed by a threaded plug 103. The second end portion 20 of third shaft G is of non-circular, transverse cross section and is adapted to removably engage any one of a number of longitudinally spaced elongate slots 104 formed in a rigid member 106 that has a handle 108 secured thereto, which elements cooperate to define a crank N. The second end portion 18 of the second shaft F as may be seen in FIG. 4 is of non-circular transverse cross-section and may be removably engaged by a driving portion of a conventional prime mover (not shown) such as an electric drill, electric motor, internal combustion engine or the like.

From the above description it will be apparent that the pump P may be selectively driven, either by manual rotation of the crank N when in removable engagement with the second end portion 20, or by the prime mover (not shown) when the crank N is separated from a driving position. The third gear 72 is substantially greater in diameter than fourth gear 74, and in practice a ratio that provides seven rotations of second shaft F relative to one rotation of third shaft G has been found satisfactory. The first, second, third and fourth gears 68, 70, 72 and 74 are of such diameter than the first and second impellers H and J may be synchronously driven without the vanes 24 and 28 contacting one another or the hubs 22 and 26.

Figure 5:
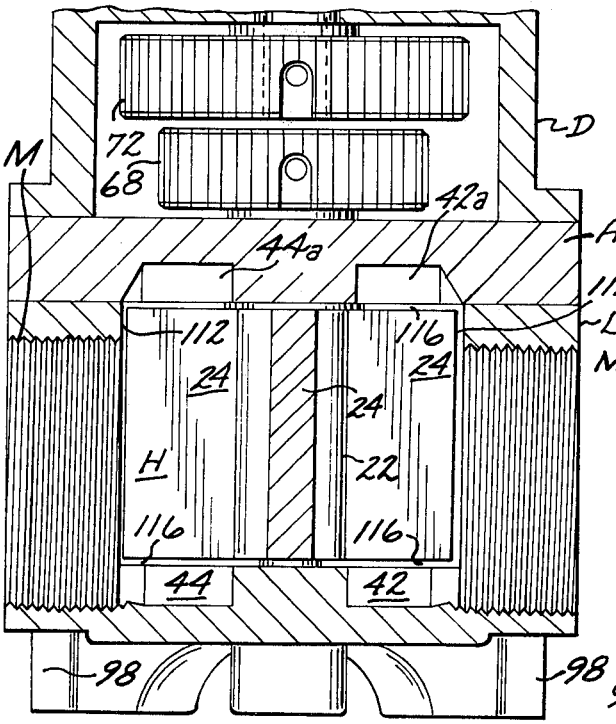
FIG. 5 is another vertical cross-sectional view of the pump taken on the line 5—5 of FIG. 2.
Figure 6:
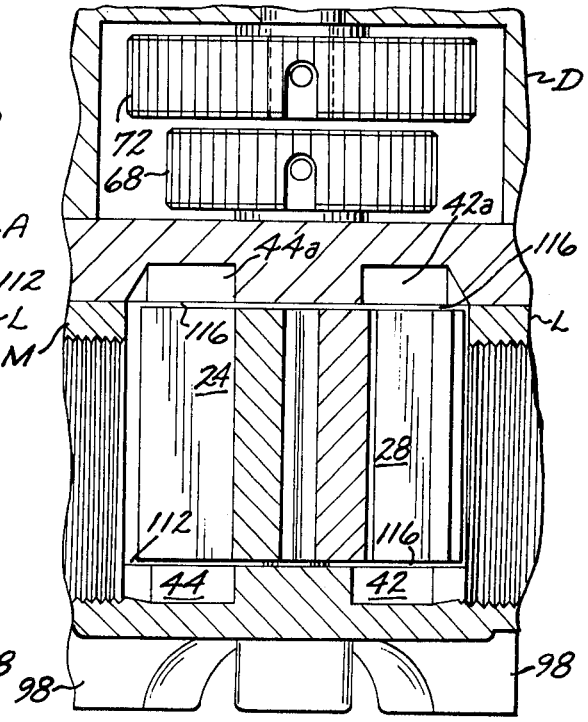
FIG. 6 is yet another vertical cross-sectional view of the pump taken on the line 6—6 of FIG. 3.

As the first impeller H rotates clockwise as viewed in FIGS. 2 and 3, and the second impeller J rotates concurrently in a counter clockwise direction, fluid that has entered inlet L flows into first and second laterally spaced confined spaces 110 and 112 defined by the first and second vanes 24 and 28 in cooperation with end walls 40 to be forced towards the outlet M, with the direction of rotation of the impellers being indicated by arrows in FIGS. 3 and 4. The first and second vanes 24 and 28 as they concurrently rotate intermesh to sequentially define third confined spaces 114 of varying volume therebetween as shown in FIGS. 2 and 3 into which fluid adjacent outlet M flows to be forced towards the inlet L. The fluid in the confined spaces 114 is incompressible. However, the confined spaces 114 are at all times in communication with the pressure relief cavities 42 and 44 and **42*a*, 44*a* formed in the center plate A, as shown in FIGS. 5 and 6. The first and second sets of pressure relief cavities 42, 44 and 42*a*, 44*a*** are vertically aligned.

Thus, incompressible fluid in the third confined spaces 114 as the latter contract in volume does not impart a sudden shock to the first and second vanes 24 and 28 defining these confined spaces, for the fluid when pressurized may flow to the first and second sets of pressure relief cavities 42, 44 and **42*a*, 44*a*. Throbbing of the pump due to incompressible fluid being situated in the confined spaces 114 is eliminated due to the fluid being able to flow to the first and second sets of pressure relief cavities 42, 44 and 42*a*, 44*a*.**

A portion of the tips **24*a* and 28*a* of the first and second vanes 24 and 28 are separated from the surfaces 40, as well as the hubs 22 and 26 by a space 116, which is also true of the top and bottom edges of the vanes relative to the bottom 30 and center plate A. This space 116 is critical and is just sufficient to permit a slight back flow of pressurized fluid from the pressurized side of the pump chamber 36 to the non-pressurized side thereof without appreciably affecting the efficiency of the pump. The first and second hubs 22 and 26 have projections 22*a* and 26*a* on the upper ends thereof as shown in FIG. 4 to maintain the space 116** between the impellers H and J and the center plate A when the pump is disposed on the side thereof or in an upside down position.

The operation of the pump P is the same irrespective of whether manually of power driven. Fluid entering the pump chamber 36 through the inlet L will be sequentially carried in the laterally separated first and second confined spaces 110 and 112 to the portion of the pump chamber adjacent the outlet M. Fluid that has been pressurized and is adjacent the outlet M in pump chamber 36 will tend to backflow through the spaces 116 defined by the tips and side edges of the first and second vanes 24 and 28 with the surfaces defining the pump chamber. However, this portion of the back flow is quite small as the direction of the back flow is opposite in direction to the direction in which the vanes rotate. If the fluid being pumped has substantial viscosity and the spaces 116 are small, the frictional drag on the fluid in the spaces 116 above-identified is so greater as to render the back flow negligible. The above condition will prevail only if the first and second impellers are rotating concurrently at a substantial velocity.

As counter rotation of the first and second impellers H and J takes place, a portion of the pressurized fluid adjacent the outlet M will sequentially enter the confined spaces 114 as the latter form and be carried back towards the inlet L. The confined spaces 114 vary in volume, and are of minimum volume when two of the first and second vanes 24 and 28 are substantially parallel and define the confined space as shown in FIG. 3.

As the confined spaces 114 contract in volume the pressurized fluid therein may escape to either the first and second sets of pressure relief cavities 42, 44 and **42*a*, 44*a*. Pressurized fluid flowing to the outlet side of the pump chamber 36 from the third confined spaces 114 through the pressure relief cavities 44, 44*a* does not detract from the volumetric efficiency of the pump P. The pressure relief cavities 42, 44 and 42*a*, 44*a* serve a second important function. A pressure on fluid increases in third confined spaces 114 above that adjacent the discharge M, the fluid immediately tends to flow from the third confined spaces to the pressure relief cavities in a smooth manner, and as a result the fluid is pumped from discharge M substantially without pulsations. The first and second sets of pressure relief cavities 42, 44 and 42*a*, 44*a* also insure that the first and second impellers 24 and 28 will not be subjected to sudden shock as the third confined spaces 114** decrease in volume.

From the above it will be seen that the semi-positive displacement pump P operates to provide a non-pulsating discharge of fluid from the outlet M, and does not require spring means or pressure relief valves to protect the impellers from damage.

The pump P due to the modular structure thereof, may have a first housing C, first and second shafts E and F, and first and second impellers H and J of greater or lesser dimensions used therewith to vary the capacity of the pump, with the center plate A, second housing D, and first, second, third and fourth gears 68, 70, 72 and 74 remaining the same.

The portion of fluid carried in the third confined spaces 114 from the pressurized to the non-pressurized side of the pump chamber 36 lowers the efficiency of the pump P, but this loss is more than offset by the operational advantages of the pump. When the direction of rotation of the first and second impellers H and J is reversed, the outlet M serves as the fluid inlet and the inlet L serves as the fluid outlet.

The operational advantages of the pump P are that it has a high volume output, a high head, requires a minimum of power, may be selectively driven by manual or power means, is reversible as to flow, no components in the pump chamber are in touching contact, and the components accordingly have low wear.

Pump P when of the manually operated type has a capacity of up to 75 gallons per minute, a head pressure to 67 feet/20 PSI, a suction lift of up to 25 feet, is self-lubricating and can be operated dry without damage, and one in which the transmission ratio and capacity may be easily varied due to the pump being of modular structure.

The use and operation of the invention has been described previously in detail and need not be repeated.

I claim:

1. A semi-positive displacement pump of the type that includes first and second counter rotating impellers situated on spaced parallel axes in a pump chamber that has an inlet for an incompressible fluid and a discharge outlet therefor, with each of said impellers including a cylindrical hub from which a plurality of circumferentially spaced vanes extend radially, said first and second impellers when synchronously rotated sequentially defining first and second confined spaces that force said liquid in said pump chamber from a position adjacent said inlet to said outlet, said first and second impellers as they synchronously rotate defining third confined spaces of variable volume therebetween that pump a portion of said incompressible fluid in said pump chamber from a position adjacent said outlet to said inlet, said pump being characterized by operating smoothly without pulsations and including:

a. first, second and third shafts each of which has first and second end portions, with said first and second hubs engaging said first and second shafts adjacent said first end portions thereof and removably secured thereto;

b. a first gear removably secured to said second end portion of said first shaft;

c. a second gear removably secured to said second shaft intermediate said first and second end portions thereof and in engagement with said first gear;

d. a third gear removably secured to said second end portion of said third shaft;

e. a fourth gear defined on the exterior surface of said second shaft that is engaged by said third gear;

f. a center plate that has first and second spaced openings therein that rotatably engage intermediate portions of said first and second shafts, said center plate having a plurality of spaced transverse first bolt holes adjacent the edge thereof;

g. a first housing that includes a flat bottom and a first continuous side wall that extends upwardly from the latter, said side wall having an oppositely disposed fluid inlet and fluid outlet therein, first and second elongate transverse fluid pressure relief cavities in said bottom adjacent said fluid inlet and outlet, said first and second cavities separated by a first portion of said bottom in which first and second recesses are formed that rotatably engage said first end portions of said first and second shafts, said first side wall on the upper extremity thereof developing into a first outwardly extending flange that has a plurality of spaced second bolt holes therein that are aligned with said first bolt holes, with the surface of said center plate most adjacent said first housing having third and fourth pressure relief cavities therein aligned with said first and second cavities, and said first housing when said first flange is in abutting contact with said center plate cooperating with the latter to define said pump chamber in which said first and second impellers are disposed;

h. a second housing that includes a top from which a continuous side wall depends, which side wall develops into an outwardly extending second flange in which a plurality of spaced third bolt holes are defined that are in alignment with said first bolt holes when said second flange is in abutting contact with said center plate, said second housing having first and second openings therein that rotatably engage said second and third shafts, said second housing cooperating with said center plate to define a confined space in which said first, second, third and fourth gears are disposed;

i. a plurality of bolts that engage said first, second and third bolt holes to removably hold said first and second housings in abutting contact with said pressure plate;

j. manually operated means for removably engaging said second end portion of said third shaft to rotate the latter and through said first, second, third and fourth gears impart counter synchronized rotation to said first and second impellers for fluid to be pumped in said pump chamber with said incompressible fluid not imparting shock to said vanes as said third confined spaces decrease in volume due to said fluid flowing into said fluid pressure relief cavities when said incompressible fluid is pressurized in said third confined spaces; and k. engageable means on said second end portion of said second shaft that may be removably engaged by a prime mover to drive said first and second shafts and first and second impellers to pump fluid in the same manner as though said first and second shafts were driven by the manual rotation of said third shaft, with said center plate in cooperation with said first and second housings defining said pump chamber and confined space in which said first, second, third and fourth gears are disposed, said center plate defining said third and fourth fluid pressure relief cavities, and in cooperation with said first and second flanges and bolts holding said first and second housings in fixed spacing relative to one another.

2. A pump as defined in claim 1 which in addition includes:

j. a plurality of first and second pins that extend through transversely aligned bores in said hubs and first and second shafts to removably secure said first and second impellers to said first and second shafts.

3. A pump as defined in claim 2 which in addition includes:

k. a plurality of third, fourth and fifth pins that extend through transversely aligned bores in said first, second and third shafts and said first, second and third gears to removably secure said first, second and third gears to said first, second and third shafts.

4. A pump as defined in claim 1 which in addition includes:

j. bearing means in said first and second recesses in said bottom that rotatably engage said first end portions of said first and second shafts.

5. A pump as defined in claim 1 which in addition includes:

j. bearing and sealing means in said first and second openings in said center plate that rotatably engage said first and second shafts to prevent fluid in said chamber flowing into said confined space in which said first, second, third and fourth gears are disposed.

6. A pump as defined in claim 5 which in addition includes:

k. means in said second housing for introducing a lubricant into said confined space in which said first, second, third and fourth gears are disposed.

7. A pump as defined in claim 1 in which the edges of said vanes parallel to said shaft and normal to said shaft are spaced from said bottom and said center plate as well as the inside surface of said side wall of said first housing, but said spacing so related to the pressure of fluid at said outlet that the resistance to the flow of fluid through said spacing towards said inlet is so great that but a minor portion of said incompressible fluid being pumped will back flow to said inlet through said spaces.

8. A pump as defined in claim 7 in which said center portion of said bottom is at least as wide as the diameter of said hubs and there is at no time an unobstructed passage for fluid to flow from the portion of said chamber adjacent said outlet to the portion of said chamber adjacent said inlet.

9. A pump as defined in claim 7 in which the quantity of said incompressible fluid moved in said pump chamber by said third confined spaces is substantially greater than the quantity of said incompressible fluid that back flows through said spaces.

* * * * *